US005274191A

United States Patent [19]

Usa

[11] Patent Number: 5,274,191

[45] Date of Patent: Dec. 28, 1993

[54] ELECTRONIC MUSICAL INSTRUMENT USING FUZZY INTERFERENCE FOR CONTROLLING MUSICAL TONE PARAMETERS

[75] Inventor: Satoshi Usa, Hamamatsu, Japan

[73] Assignee: Yamaha Corporation, Hamamatsu, Japan

[21] Appl. No.: 912,110

[22] Filed: Jul. 9, 1992

[30] Foreign Application Priority Data

Jul. 11, 1991 [JP] Japan ..... 3-171242
Jul. 11, 1991 [JP] Japan ..... 3-171243
Jul. 11, 1991 [JP] Japan ..... 3-171244

[51] Int. Cl.[5] ..... G10H 1/00

[52] U.S. Cl. ..... 84/600; 84/626; 395/900

[58] Field of Search ..... 84/600–608, 84/626; 395/3, 900, 902

[56] References Cited

U.S. PATENT DOCUMENTS 4,649,783 3/1987 Strong et al. .
4,864,490 9/1989 Nomoto et al. ..... 395/3 X

FOREIGN PATENT DOCUMENTS 2-146094 6/1990 Japan .
2-146095 6/1990 Japan .
2-146593 6/1990 Japan .
2-146594 6/1990 Japan .
2-146596 6/1990 Japan .
2-146597 6/1990 Japan .
0071303 3/1991 Japan ..... 395/3

OTHER PUBLICATIONS

Palaz, Ibrahim, and Weger, Ronald C. "Waveform recognition using neural networks" Mar. 1990 *Geophysics* pp. 28–32.

Johnson, Margaret L. "Toward An Expert System for Expressive Musical Performance" Jul. 1991 *Computer* pp. 30–34.

*Primary Examiner*—William M. Shoop, Jr.
*Assistant Examiner*—Jeffrey W. Donels
*Attorney, Agent, or Firm*—Graham & James

[57] ABSTRACT

An electronic musical instrument has a fuzzy inferring function. The instrument is provided with a rule storage memory for storing a plurality of fuzzy rules each of which is selectable. The instrument fuzzy-infers musical tone control parameters, such as a control amount of amplitude fluctuation, a control amount of pitch fluctuation, a control amount of noise or the like, based on the inputted playing data according to selected fuzzy rules. The instrument has a fuzzy rule input device for inputting desirable fuzzy rules which are used as a part of the stored plurality of fuzzy rules.

12 Claims, 14 Drawing Sheets

FIG. 4 (A)
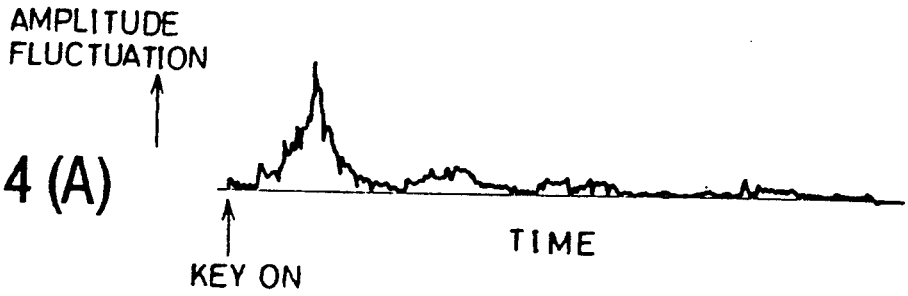
FIG. 4 (B)
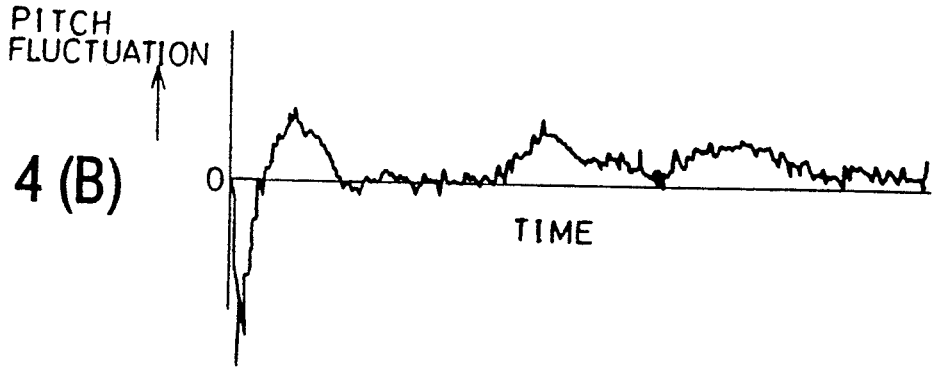
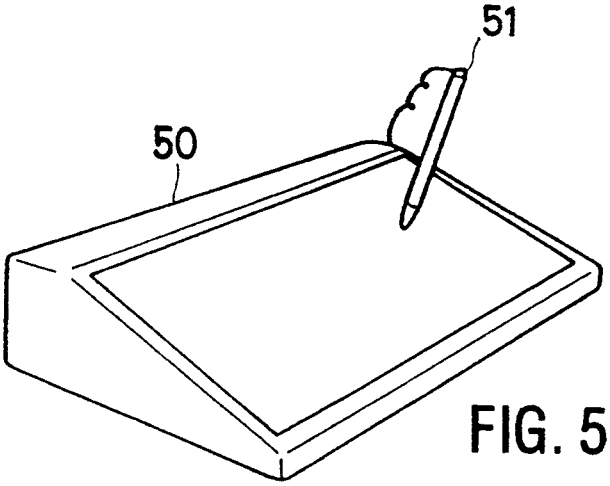
FIG. 5

| (INPUT FUZZY OPERATION) | (WRITING REGISTER OF FUZZY OPERATOR) | (FUNCTION USED FOR MIN. CALCULATION) | (RULE) |
|---|---|---|---|
| min(MA1(VEK),TG(CNT)) → | R1 | F1A | VARIATION DEGREE OF FLUCTUATION AMOUNT BY VELOCITY OF IMMEDIATELY AFTER KEY ON |
| min(MA2(VEK),TG(CNT)) → | R2 | F2A | |
| MA3(AFT) → | R3 | F3A | VARIATION DEGREE OF FLUCTUATION AMOUNT BY AFTER TOUCH |
| MA4(AFT) → | R4 | F4A | |
| MA5(KCD) → | R5 | F5A | VARIATION DEGREE OF FLUCTUATION AMOUNT BY KEY CODE |
| MA6(KCD) → | R6 | F6A | |
| MA7(ΔKCD) → | R7 | F7A | VARIATION DEGREE OF FLUCTUATION AMOUNT BY TONE PITCH VARIATION FROM PREVIOUSLY TURNED ON KEY |
| MA8(ΔKCD) → | R8 | F8A | |
| MA9(ΔT) → | R9 | F9A | FLUCTUATION DEGREE ACCORDING TO LAPSE TIME FROM PREVIOUSLY TURNED ON KEY |
| MA10(ΔT) → | R10 | F10A | |
| SL → | R11 | F11A | FLUCTUATION DEGREE DURING SLUR |

FIG. 6

| (INPUT FUZZY OPERATION) | | (WRITING REGISTER OF FUZZY OPERATOR) | | (FUNCTION USED FOR MIN. CALCULATION) | (RULE) |
|---|---|---|---|---|---|
| MN1(VEL) | → | R1 | · · · | F1N | NOISE AMOUNT CONTROL BY VELOCITY |
| MN2(VEL) | → | R2 | · · · | F2N | |
| MN3(VEL) | → | R3 | · · · | F3N | KEY SCALING BY NOISE AMOUNT |
| MN4(VEL) | → | R4 | · · · | F4N | |
| MN5(VEL) | → | R5 | · · · | F5N | NOISE AMOUNT AND STABILIZATION CONTROL BY AFTER TOUCH |
| MN6(VEL) | → | R6 | · · · | F6N | |
| MN7(VEL) | → | R7 | · · · | F7N | NOISE STABILIZATION CONTROL BY VELOCITY |
| MN8(VEL) | → | R8 | · · · | F8N | |
| MN9(VEL) | → | R9 | · · · | F9N | KEY SCALING BY NOISE STABILIZATION |
| MN10(VEL) | → | R10 | · · · | F10N | |
| MN11(VEL) | → | R11 | · · · | F11N | NOISE SMALL DEGREE AND NOISE STABILIZATION AT SLUR PERIOD |

FIG. 7

ELECTRONIC MUSICAL INSTRUMENT USING FUZZY INTERFERENCE FOR CONTROLLING MUSICAL TONE PARAMETERS

BACKGROUND OF THE INVENTION

1. Field of the Invention

The present invention relates to an electronic musical instrument having a fuzzy device which controls musical tone signals to be generated with a fuzzy inference.

2. Description of the Prior Art

The methods for controlling musical tone parameters and controlling musical tones after detecting a player's playing fashion by the fuzzy inference have been described in Japanese Patent Laid-open hei 2-146094, 2-146095, 2-146593, 2-146594, 2-146596, and 2-146597. These methods allow an electronic musical instrument to consider various complicated information, resulting in controlling delicately musical tones.

The above-mentioned arts, however, have a plurality of fuzzy-rules and membership-functions previously set so that these factors can't be changed any time, and any desired factors can't be selected any time. Therefore, a player can't adjust a characteristic of an electronic musical instrument so as to fit the player's favorite playing style. Further more, the above mentioned arts perform only the fuzzy inference based on initial touch data and the like at the beginning of the tone generation of the musical tone, but not control enough the time variation of the musical tone by the fuzzy inference.

SUMMARY OF THE INVENTION

It is therefore an object of the present invention to provide an electronic musical instrument having a fuzzy inference which allows a player to freely select any desired fuzzy rules.

It is another object of the present invention to provide an electronic musical instrument having a fuzzy inference which allows a player to input and edit any desired fuzzy rules and membership functions.

It is still another object of the present invention to provide an electronic musical instrument having a fuzzy inference which is capable of generating musical tones in variety to thereby make expression of the musical tones rich.

In accordance with the present invention, an electronic musical instrument having a fuzzy device comprises playing data input means for inputting playing data, rule storage means for storing a plurality of fuzzy rules, rule selection means for selecting rules to be activated out of the fuzzy rules, and fuzzy inference means for fuzzy inferring musical tone control parameters, such as a control amount of amplitude fluctuation, a control amount of pitch fluctuation and a control amount of noise, based on the playing data inputted from the playing data input means by use of the selected rules. Since any desired fuzzy rules can be selected, a player can freely use the fuzzy rule that fit his favorite playing style.

Also, in accordance with the present invention, the fuzzy rules and membership functions used for the fuzzy rules can be inputted and edited. Further, in accordance with the present invention, the parameters are inferred in real time These configurations allow the electronic musical instrument to control musical tones which fit the player's favorite playing style, and to make the expression of the generated musical tones variety.

BRIEF DESCRIPTION OF THE DRAWINGS

FIGS. 4A and 4B show a pitch fluctuation wave and an amplitude fluctuation wave.

FIG. 5 illustrates a schematic appearance of a tablet device used for the electronic musical instrument.

FIG. 6 shows fuzzy rules of the fuzzy inference processed in the electronic musical instrument.

FIG. 7 shows other fuzzy rules of the fuzzy inference processed in the electronic musical instrument.

DETAILED DESCRIPTION OF THE PREFERRED EMBODIMENTS

Figure 1:
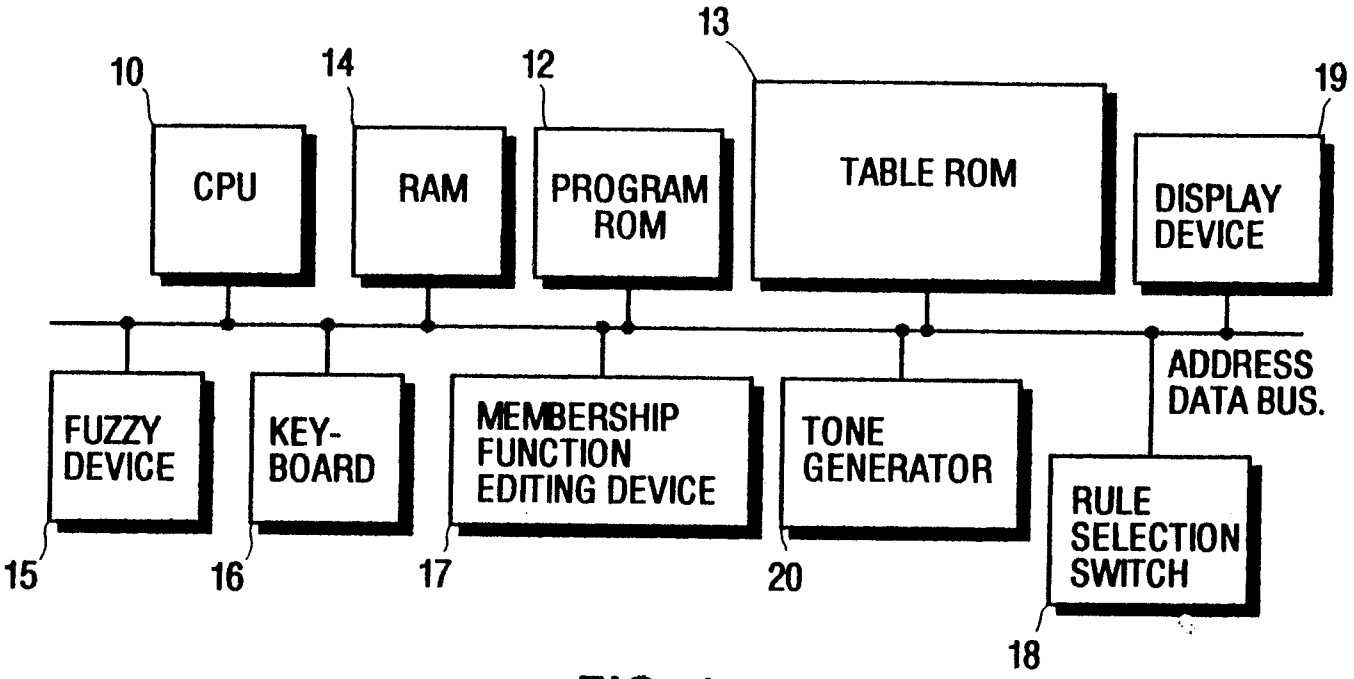
FIG. 1 is a block diagram of an electronic musical instrument embodying the present invention.

FIG. 1 is a block diagram of an electronic musical instrument embodying the present invention.

Figure 2:
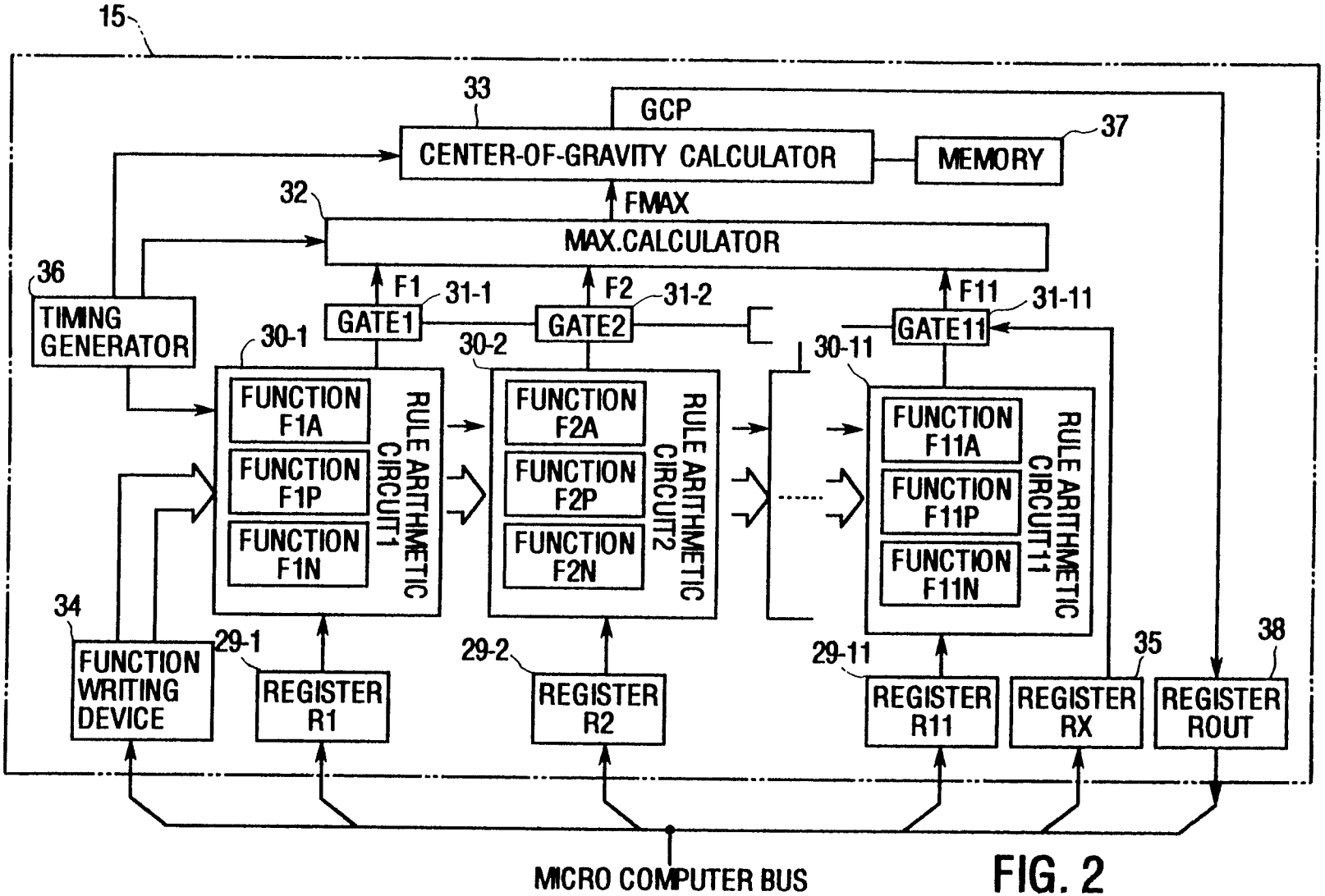
FIG. 2 illustrates a configuration of a fuzzy device of the electronic musical instrument.
Figure 3:
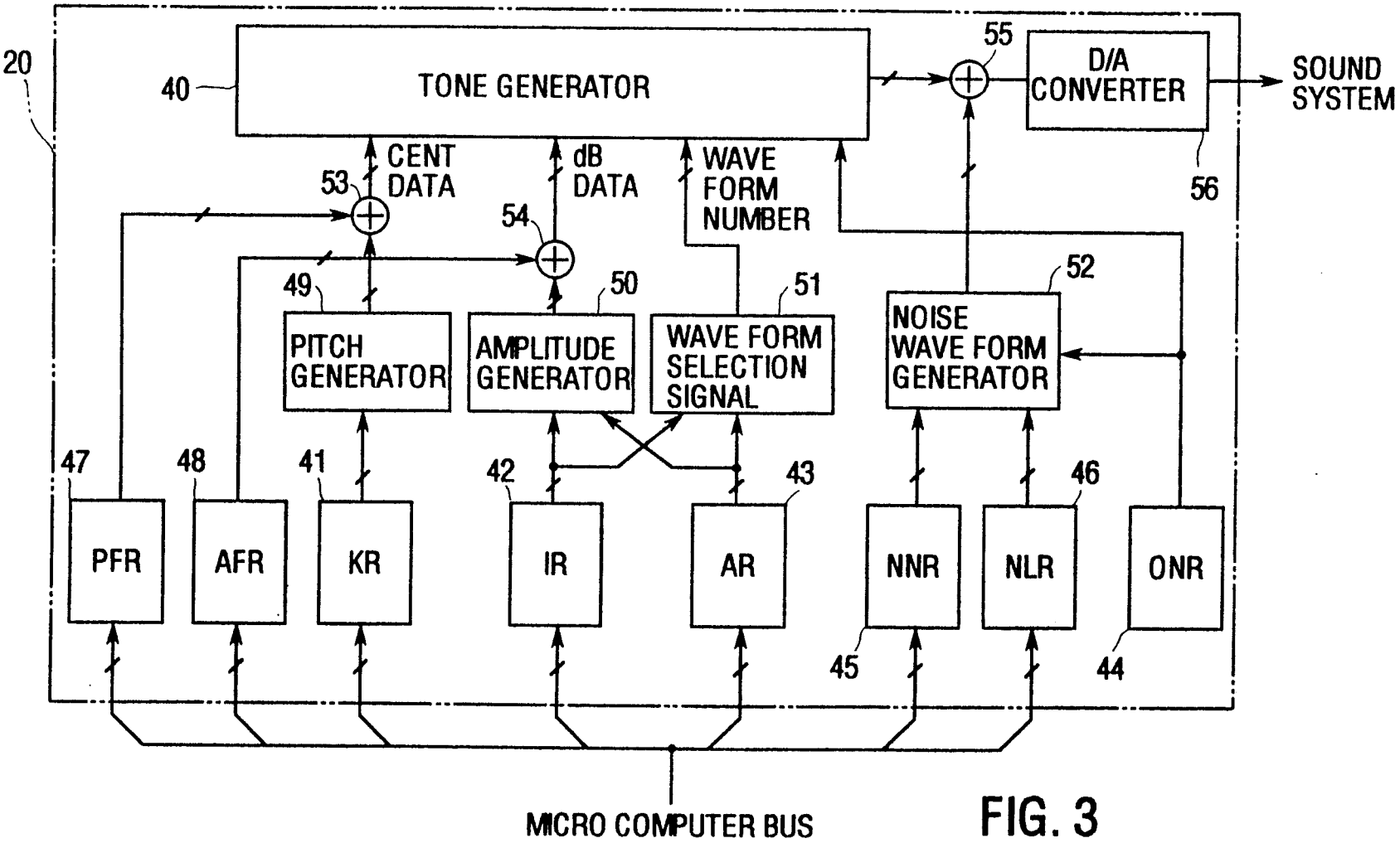
FIG. 3 illustrates a configuration of a tone generator of the electronic musical instrument.

The electronic musical instrument is a digital type electronic musical instrument which is controlled by a CPU 10. The CPU 10 is connected to a program ROM 12, a table ROM 13, a RAM 14, a fuzzy inference device 15, a keyboard 16, a membership function editing device 17, a rule selecting device 18, a display 19, and a tone generator 20 through an address and data bus 11. The program ROM 12 stores a program shown in a flowchart descried later. The table ROM 13 stores the membership functions used in calculation of a so-called condition part when the fuzzy inference is carried out and fluctuation wave data of an amplitude and a pitch. The RAM 14 has registers which temporarily store data generated during playing. The fuzzy inference device 15 is provided with a plurality of function generators as shown in FIG. 2, and performs the fuzzy inference based on inputted variable data. The keyboard 16 is provided with keys (sixty keys) of five octaves, and is capable of outputting on/off data, velocity data and after touch data of each key. The membership function editing device 17 is a tablet type input device as shown in FIG. 5, and is capable of setting freely a figure of the membership function. The rule selecting switch 18 is a switch for selecting a rule which is edited by the membership function editing device 17 or the fuzzy rule to be operated during playing. The switch 18 has a + key for selecting the rule, an on/off key for designating an on or off condition of the rule, and a cursor key for selecting the membership function. The display 19 is a matrix LCD type display, displaying setting data of the playing and the membership function to be edited (see FIG. 15). The tone generator 20 has a tone generator 40 as shown in FIG. 3, generating musical tone signals by imparting various parameters to the tone generator 40. It is available to select the type of the tone generator 40 out of any type tone generators, such as an FM tone generator.

FIG. 2 is a detailed block diagram of the above described fuzzy inference device 15. The fuzzy inference device 15 is provided with eleven rule arithmetic circuits 30 (30-1 to 30-11), a maximum value calculator 32, and a center-of-gravity calculator 33. The fuzzy inference device 15 is so arranged as to perform the three fuzzy inference processes each of which is independent in time sharing. The three fuzzy inference processes output a control amount of amplitude fluctuations AFL, a control amount of pitch fluctuations PFL, and a control amount of noises (noise level NL and noise number NN). Each of the eleven rule arithmetic circuits 30 performs the arithmetic of the different fuzzy rule. Each of the rule arithmetic circuits 30 has internal RAMs (FnA, FnP, and FnN (n=1 to 11)) for storing output membership functions for performing the above three type fuzzy inferences. When the membership function is rewritten by the editing operation, the new membership function is written by a function writing device 34. Each of the membership value of each of the membership function is inputted into each of the rule arithmetic circuit 30. The membership value is calculated by the CPU 10, being set into registers 29 (29-1 to 29-11).

The arithmetic result of the rule arithmetic circuit 30 is inputted into the maximum value calculator 32 through gates 31 (31-1 to 31-11). The maximum value calculator 32 is a calculator for overlapping the functions outputted from the gates 31. The overlapped (ORed) maximum function is inputted into the center-of-gravity calculator 33. The center-of-gravity calculator 33 calculates the center of gravity of the inputted function, and output it as the fuzzy inference value. The outputted fuzzy inference value is temporarily stored in an output register 38, and is fetched by the CPU 10 through the bus. The rule arithmetic circuits 30, the maximum value calculator 32, and the center-of-gravity calculator 33 work synchronously depending on the timing signal generated from a timing signal generator 36. The eleven gates 31 located between the rule arithmetic circuits 30 and the maximum value calculator 32 work to connect or disconnect the rule arithmetic circuits 30 (30-1 to 30-11) with the maximum value calculator 32, respectively. Each of the gates 31 is controlled by each bit of eleven bits data inputted into a register 35. The input data into the register 35 is set by the rule selection switch 18. That is, a player can select any rule arithmetic circuit 30.1 to 30.11 by use of the rule selection switch 18.

The above fuzzy inference device 15 performs the following operation. First, the rule arithmetic circuits 30 work synchronous to the timing signal. The data set in each of the registers 29 is, as the variable data, inputted into each of the membership function in each of the circuits 30 In each of the rule arithmetic circuits 30, the so called minimum value calculation is carried out, i.e., the input data from the register 29 is applied to each membership function, and the output of the function is outputted to the gate 31. The gates 31 receive every output data of the rule arithmetic circuits 30, but only opened gates pass the data to input it into the maximum value calculator 33. The maximum value calculator 32 works so as to select the maximum value out of the output data from the opened gates for each timing, and the center-of-gravity calculator 33 accumulates the output data of the maximum value calculator 33 and stores the accumulated result into a memory 37. When the accumulation is finished, the final accumulation value is divided by two (i.e., one bit is shifted down), the memory area which the same value as the divided value is stored is searched in the memory 37. The horizontal axis value corresponding to the timing when the same value is searched is the center of gravity. The value of the center of gravity is written into an output register 38.

FIG. 3 is a block diagram of the above mentioned tone generator 20. The tone generator 40 is formed by an FM tone generator LSI. The generated musical tone signals are added at an adder 55 to noise wave signals generated at a noise wave generator 52. The output signals of the adder 55 is digital-analogue converted at a digital analogue converter 56, and the converted signals are outputted to a sound system. To the tone generator 40, cent data, decibel data, wave number data and a note-on signal ar inputted. To the noise wave generator 52, noise number data, a noise level and the note-on signal are inputted. The cent data is generated by a key code register 41, a pitch generator 49, a pitch variation register 47 and an adder 53. To the key code register 41, a key code of an on-key is inputted from the CPU 10. The pitch generator 49 serves for changing the key code inputted into the key code register 41 to data corresponding to the key code. The pitch fluctuation data generated by the fuzzy inference device 15 is inputted into the pitch variation register 47. The pitch fluctuation data is numeric data relating to a frequency as well as the data generated by the pitch generator 49. These data are added at the adder 53 and the added data is inputted into the tone generator 40 as the cent data. The decibel data is generated by an initial touch register 42, an after touch register 43, an amplitude generator 50, an amplitude variation register 48 and an adder 54. The amplitude generator 50 generates an amplitude value based on the initial touch data and the after touch data inputted from the initial touch register 42 and the after touch register 43. The generated amplitude value is added to the amplitude variation data at the adder 54 to form the decibel data. The wave number is generated by the initial touch register 42, the after touch register 43 and the wave selection signal generator 51. The wave number is a number representative of a wave the tone generator 40 uses. The noise number and the noise level data inputted into the noise wave generator 52 are set into the noise number register 45 and the noise level register 46 from the CPU 10.

FIG. 4 shows an amplitude fluctuation wave AFW (CNT) and a pitch fluctuation wave PFW (CNT) stored in the table memory 13. The variation wave is obtained by sampling a rising edge of a musical tone of a natural brass instrument, being stored in the table memory 13 for each sampling timing. When the generation of the musical tone is started, the CPU 10 reads the data successively, and set the data into the pitch variable register 47 and the amplitude variable register 48.

FIG. 5 shows a tablet input device used as the above membership function editing device. The tablet input device is provided with a tablet body 50 and a pen 51. When the pen 51 is used to draw a shape of a membership function on the tablet body 50, the shape is set as the function shape of the specified membership function.

FIG. 6 illustrates a set of fuzzy inference rules for inferring the control amount of amplitude fluctuations AFL. FIG. 7 illustrates a set of fuzzy inference rules for inferring the control amount of noises NL and NN. Each rule is a rule based on initial touch data VEL, a time period ΔT till this key-on time from the previous key-off time of any key, a time period from the beginning of the tone generation, after touch data, a key code, a tone pitch (a difference between the tone pitch of the previous time and that of this time) and the like.

The ten rules from the first rule to the tenth rule for inferring the above AFL are divided into five sets each of which has two rules. The sets of rules serves for inferring based on, respectively, 1) a degree in smallness and that in largeness of the initial touch data VEL and a degree in shortness and that in longness of the time period from the beginning of the tone generation, 2) a degree in largeness and that in smallness of the after touch, 3) a degree in largeness and that in smallness of key code, 4) a degree in highness and that in lowness of the tone pitch, and 5) a degree in longness and that in shortness of the interval time. The eleventh rule serves for inferring based on a legato degree (this legato degree is inferred by another inference process). The membership values in the condition part of the fuzzy rule set into the registers 29-1 to 29-11 are membership values calculated as the front condition membership values of the fuzzy rules by the CPU 10. The fuzzy inference for the control amount of the pitch fluctuation uses the same rules as the amplitude fluctuation.

Further more, in the fuzzy inference concerning to the control amount of the noise NN, NL shown in FIG. 7, the fuzzy inference is performed based on 1) the degree in largeness and that in smallness of the initial touch data VEL, 2) the degree in largeness and that in smallness of the key code, 3) and the degree in largeness and that in smallness of the after touch as well as the control amount of the amplitude fluctuation AFL. The noise level NL is obtained by use of the first rule to the sixth rule and the eleventh rule, and the noise number (namely, the stability degree of the noise) is obtained by use of the fifth to eleventh rules.

The five and six rules relating to the after touch AFT and the eleventh rule relating to the legato degree are used in the both inferences of the AFL and the NL, NN, so that two cycles are used for the inference relating the NL, NN.

Figure 8:
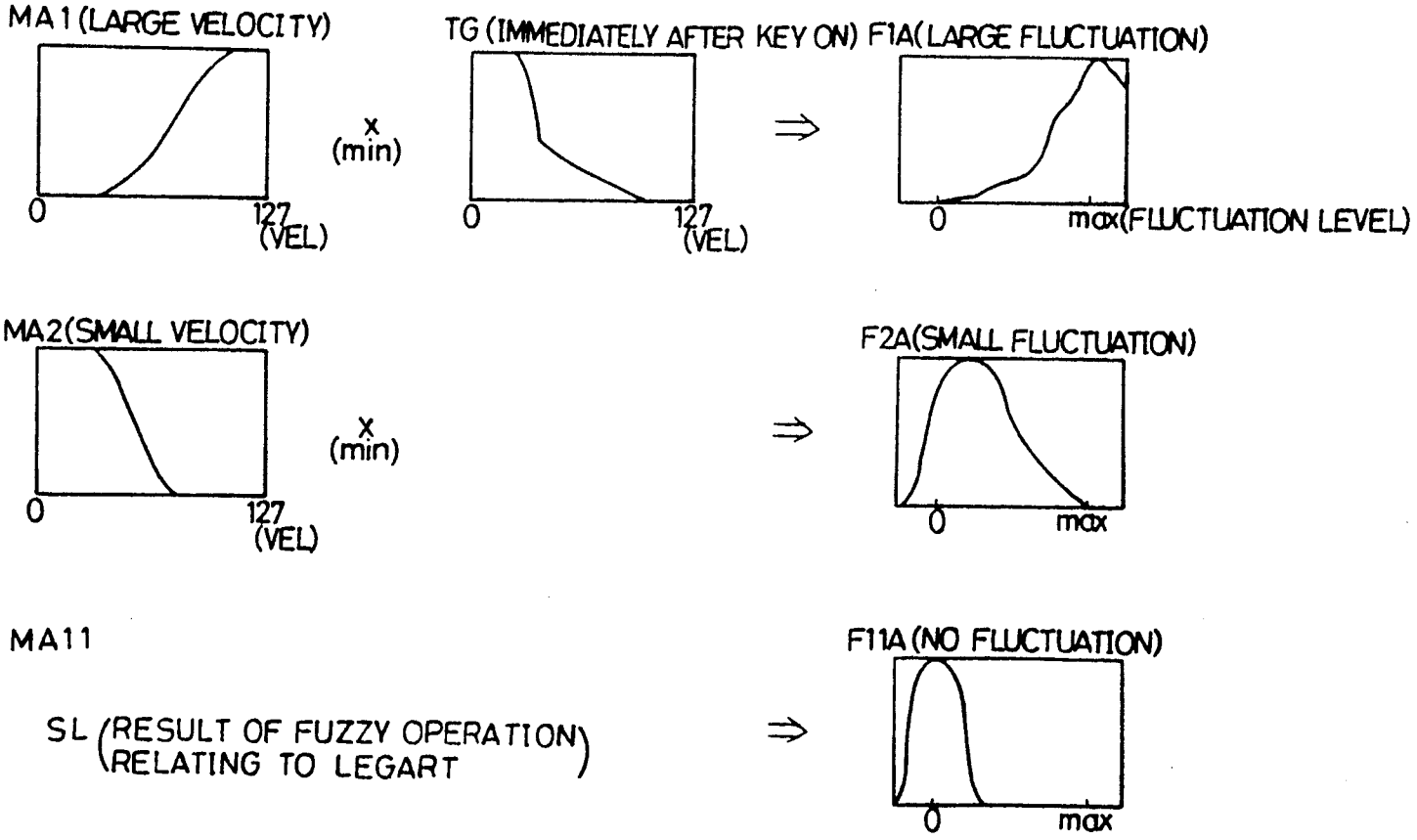
FIG. 8 shows membership functions used for the fuzzy inference.

FIG. 8 shows an example of several membership functions for finding the membership value in the condition part. These membership functions are used in the first, second, and eleventh rules of AFL.

FIGS. 9 to 14 are flowcharts showing the process of the above mentioned electronic musical instrument.

Figure 9:
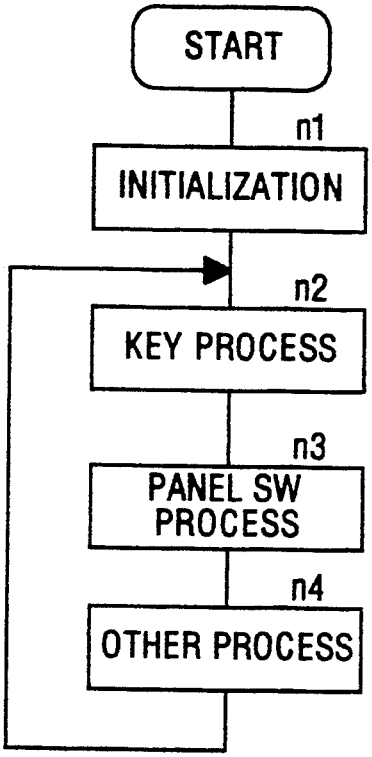
FIGS. 9 to 14 are flowcharts showing the process of the electronic musical instrument.

FIG. 9 is a main flowchart. In the flowchart, the initial setting process is carried out immediately after the start of the instrument (n1). The initial setting process includes a reset process of the registers and a sending process of preset tone color data. After that, a key process (n2), a panel switch process (n3) and the other process (n4) are repeatedly performed.

Figure 10:
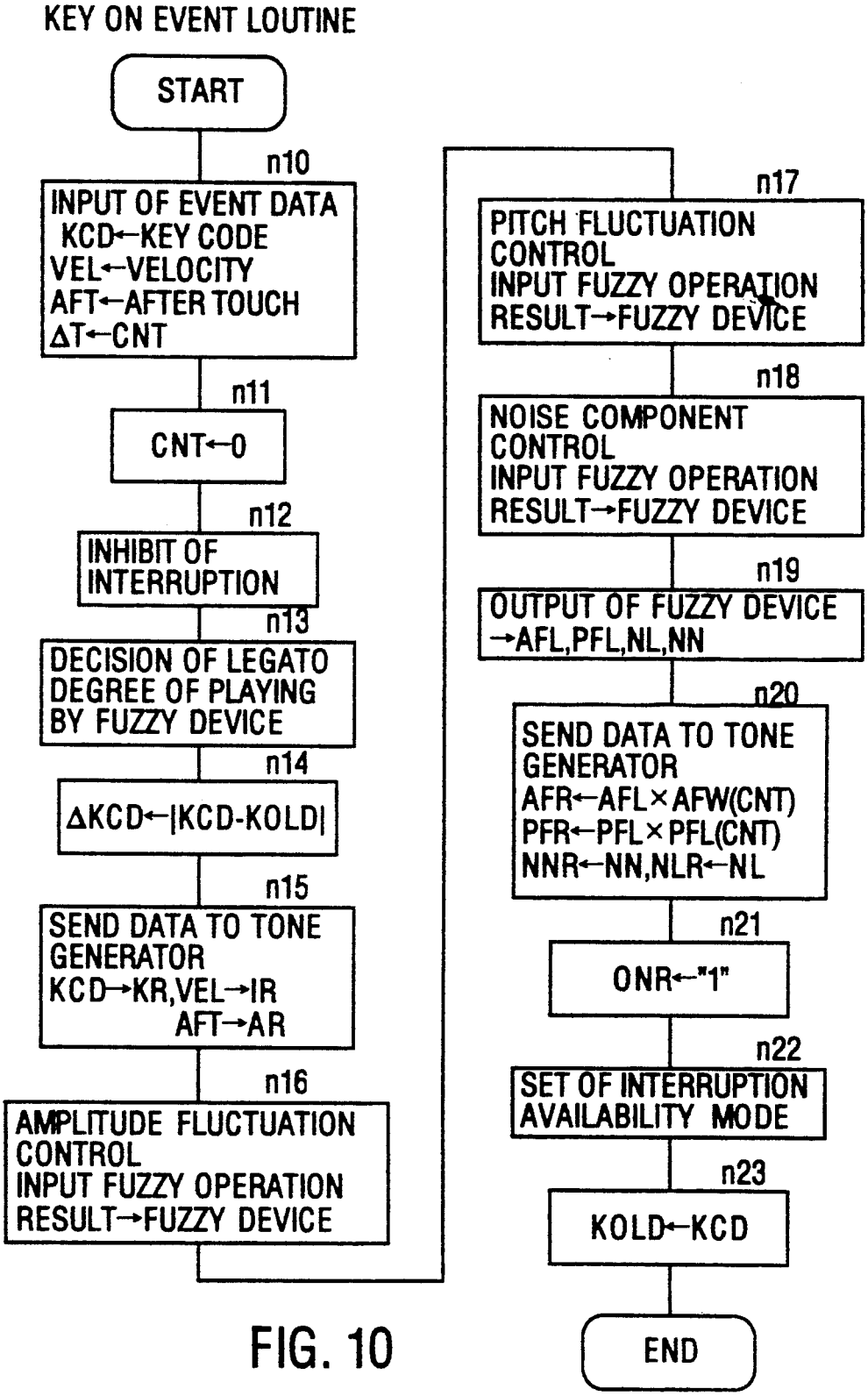

FIG. 10 is a flowchart showing a key-on event routine. First, data relating to a key turned on is set into some registers (n10). The data includes the key code (KCD), the velocity (initial touch ) data VEL, the after touch data AFT, and the time lapse period ΔT from any key-off. Next, a time counter CNT is reset (n11), any interruption during the tone generation being inhibit (n12). Next, the legato degree is inferred by the fuzzy inference, the result being set into a legato degree register SL (n13). The inference of the legato degree can be done by the manner taught in Japanese Patent Laid-open hei 2-146596 or the like. The difference of tone pitch between the tone immediately before the present time and the tone of the newly turned on key is calculated, and the result is set into a register ΔKCD (n14). The key code KCD, the velocity data VEL, and the after touch data AFT are set into registers 41, 42, 41 of the tone generator (!%). Next, the membership value in the condition part is calculated based on the data, and the result is sent to the fuzzy inference device 15 to thereby infer the parameters of the control amount of the amplitude fluctuation AFL, the control amount of the pitch fluctuation PFL, and the control amount of the noise NL, NN (n16, n17, n18). The inference result data is taken (n19). Then, the control amount of the amplitude fluctuation AFL is multiplied by the wave data of the amplitude fluctuation AFW to obtain the amplitude variation data AFR, and the control amount of the pitch fluctuation PFL is multiplied by the wave data of the pitch fluctuation PFW (CNT) to obtain the pitch variation data PFR. These data and the control amount of the noise NL, NN are sent to the tone generator 20 (n20). After the data is set into the tone generator 20, a note-on signal is sent (n21). Namely, "1" is set into a note-on register ONR 44. Finally, the interruption inhibit mode is reset (n22), and the key code of the newly turned-on key is set into the register KOLD (n23).

Figure 11:
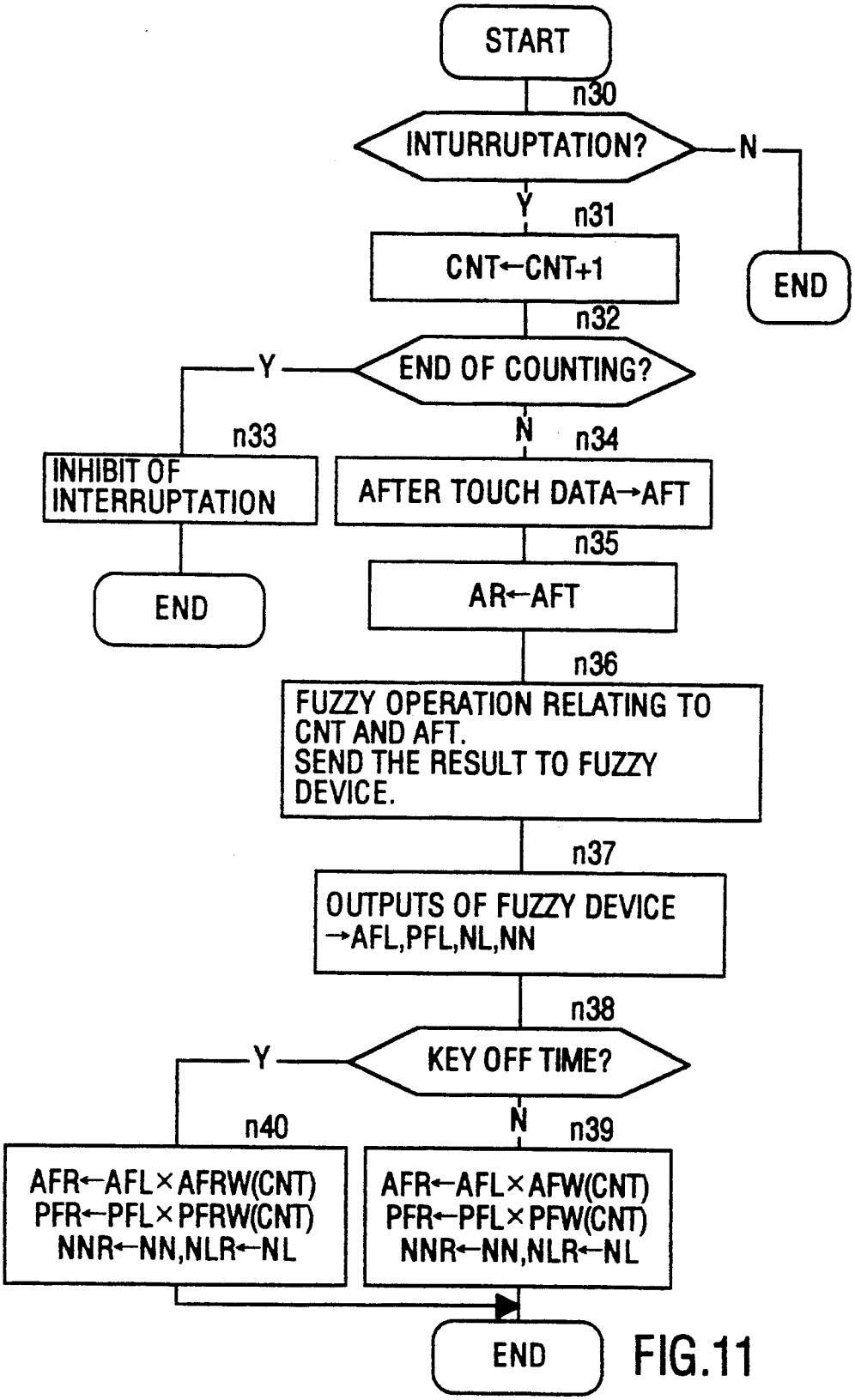

FIG. 11 is a flowchart showing the interruption process. First, whether any interruption has occurred or not is judged (n30). The interruption is a timer one which interrupts the CPU for each specified time period. The interruption is judged by watching a flag which is set when any interruption occurs. If no interruption occurs, the process returns. If any interruption has occurred, the counter CNT is incremented (n31), and whether the count value meets the end value is judged (n32). The count end causes the process to end by inhibiting the interruption (n33). If the count value of the counter CNT is not the end value, the after touch data of the turned-on key is taken and the data is set into the register AFT (n34). The data is copied to the after touch register AR 43 (n35), and the membership value in the condition part (see FIG. 6, 7) calculated by use of the CNT and the AFT is sent to the fuzzy inference device 15 (n36). The inference output is taken from the fuzzy inference device (n37), the AFW and the PFW are calculated during the key-on status as well as the step n20 to send it to the tone generator 20 (n39), and the amplitude variation wave AFRW(CNT) at the release period and the pitch variation wave at the release period during the key-off status are used to calculate the AFR and the PFR, and the calculated result is sent to the tone generator 20 (n40).

Figure 12:
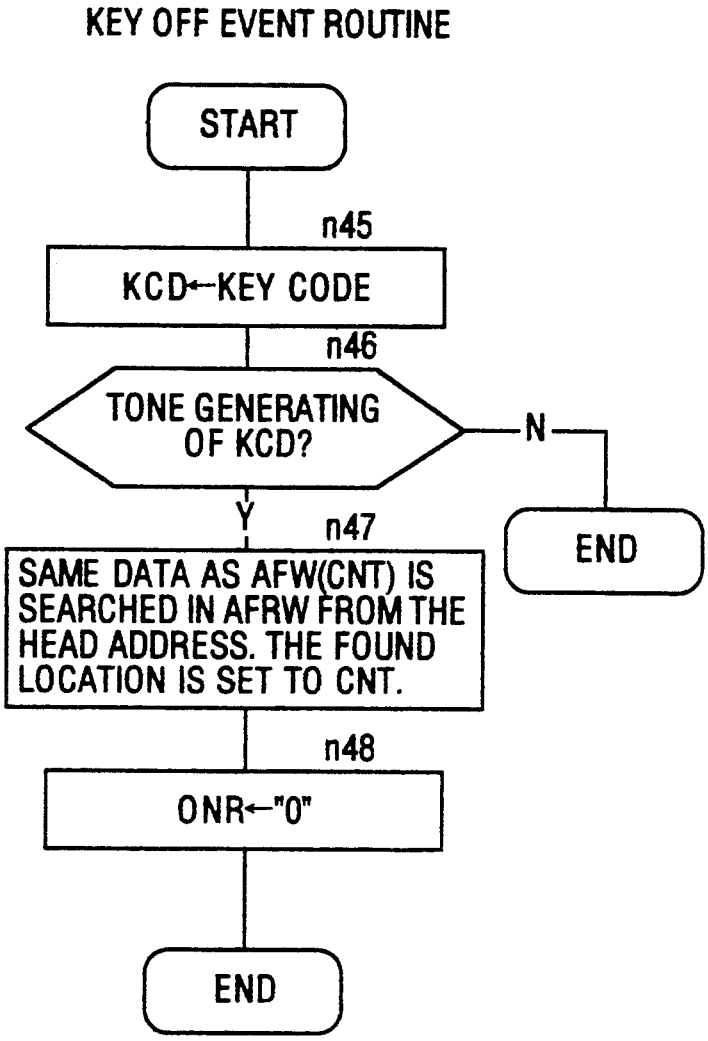

FIG. 12 is a flowchart showing a key-off event routine. The key code of the turned-off key is taken into the key code register KCD (n45), and whether the tone of the key code is in the generation mode is judged (n46). If the tone is in the generation mode, the same value as the amplitude variation amount AFW(CNT) is searched from the release-amplitude variation amount AFRW, and the location of the same value is set into the CNT (n47). After that, the note-on signal ONR is reset (n48) and the process returns.

Figure 13:
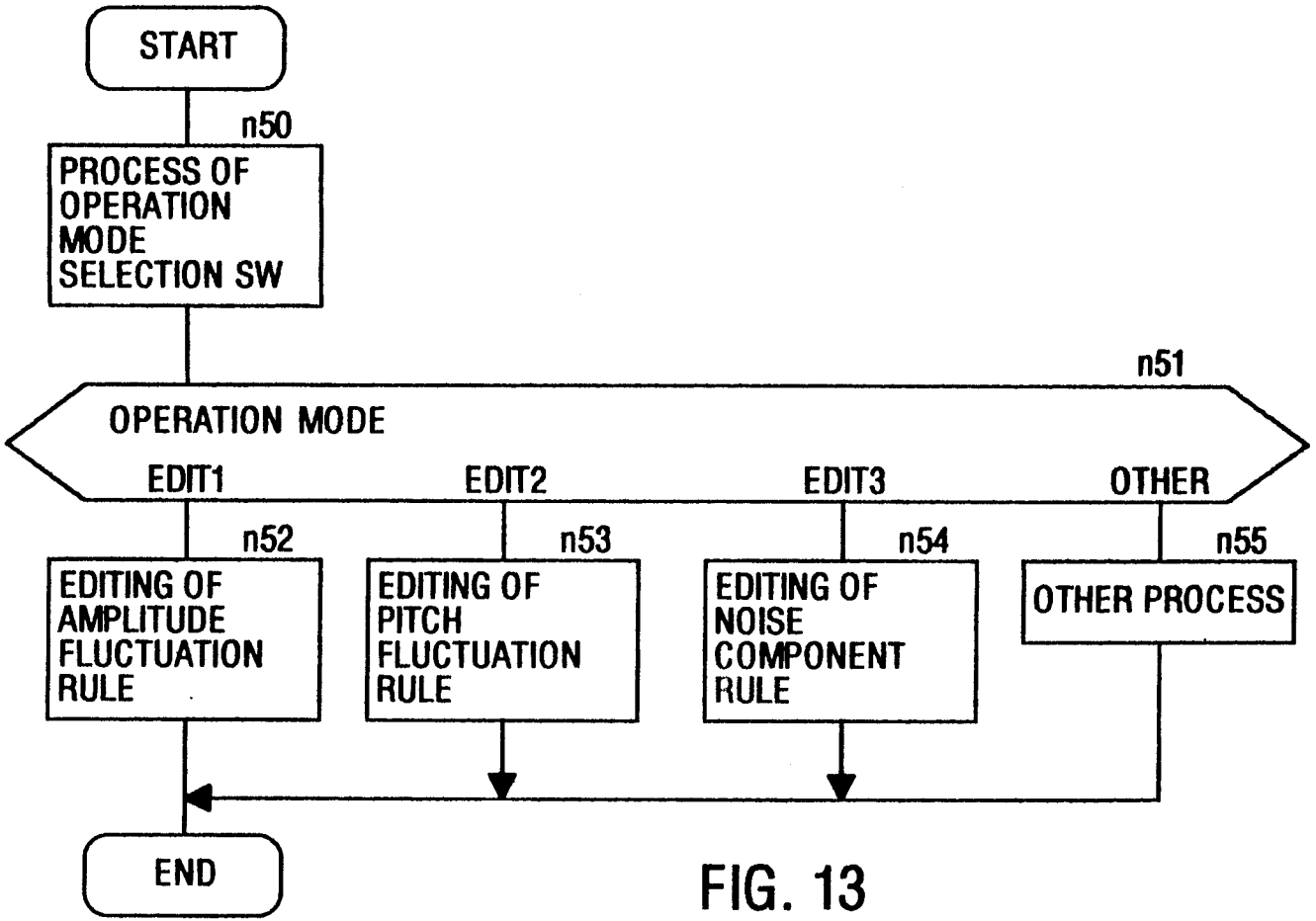

FIG. 13 is a flowchart showing a switch event process. First, an operation mode is set according to the turned-on switch (n51), and the screen of the mode is displayed on the display (n50). If the operation mode is the edit 1 mode, i.e., the edit mode relating to the amplitude fluctuation rule, the process goes to n52. If the operation mode is the edit 2 mode, i.e., the edit mode relating to the pitch fluctuation rule, the process goes to n53. If the operation mode is the edit 3 mode, i.e., the mode relating to the noise control rule, the process goes to n54. The other mode causes the process to go n55.

Figure 14:
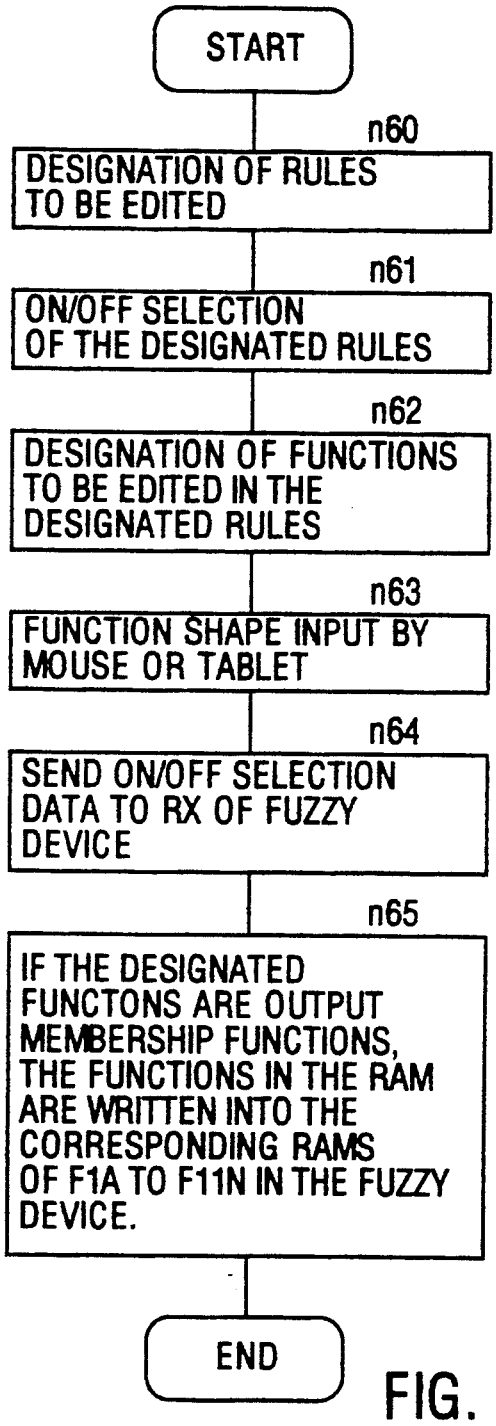
Figure 15:
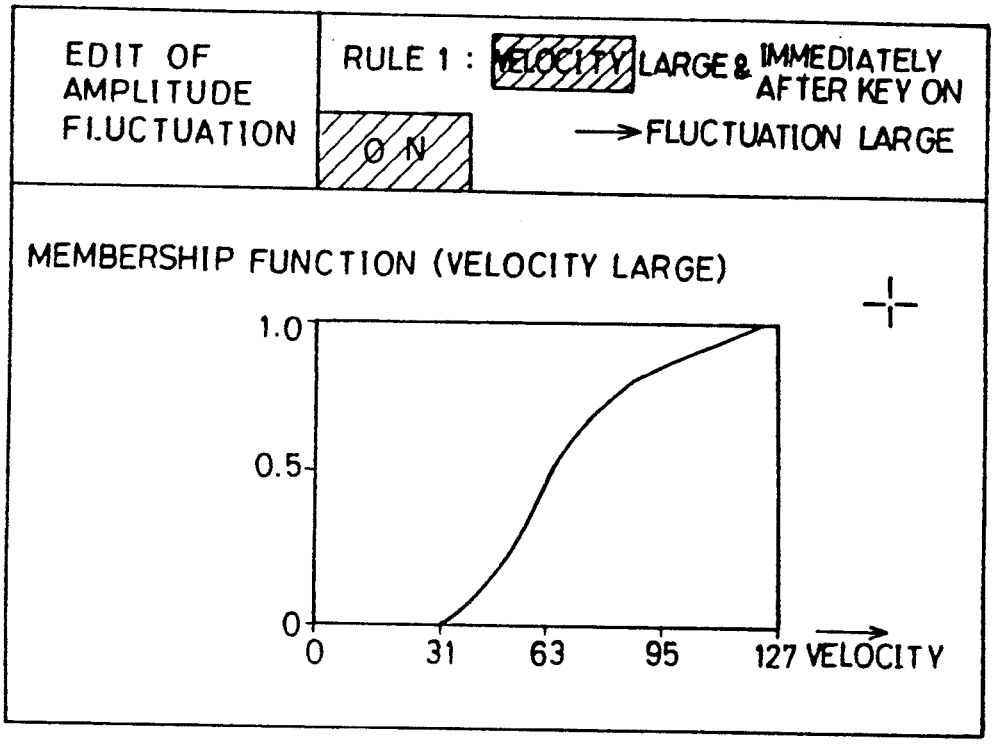
FIG. 15 shows an example of a displayed screen at an editing mode.
Figure 16:
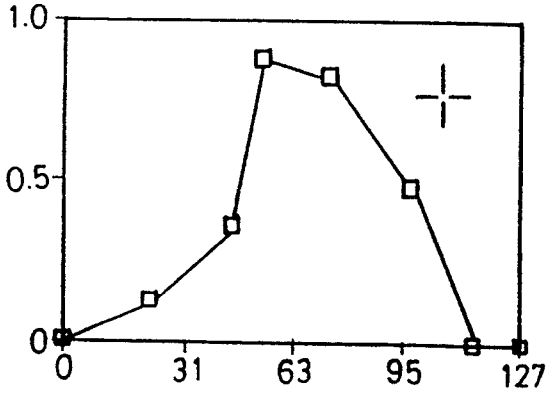
FIG. 16 shows an input example of a membership function.

FIG. 14 is a flowchart showing the rule editing process. The process is carried out at n52, n53 and n54. First, rules for editing (refer to FIGS. 6,7) are designated (n60). The + key and the − key are used for the designation. An on/off selection process for the designated rules is carried out (n61). The on-switch and the off-switch are used for the selection process. Next, Membership functions to be edited in the designated rules are specified (n62). The cursor key or the like is used for the specifying, and the display device 19 displays the specified function as shown in FIG. 15. The shape of the function is inputted by the operation of the membership function editing device 17 (n63). It is possible to specify the shape by drawing the cursor, or by plotting a plurality of points as shown in FIG. 16. The on-off data of each rule set in FIG. 16 is sent to the register (RX) 35 of the fuzzy inference device 17 (n64). Furthermore, the function that is edited at n63 is an output membership function of the condition part, the function is sent to the fuzzy inference device 15 to thereby write it to the corresponding internal RAMs F1A to F11N (n65).

According to the above process, a player can select freely any fuzzy rule and edit the membership function relating to the fuzzy rule. It is possible that the membership function editing device 17 is a mouse or a digitizer in place of the tablet input device.

In this example, the fuzzy inference is performed in two stages of largeness and smallness. It is possible to perform the fuzzy inference in three or more stages. Also, in this example, when the fuzzy rule is edited, the previous rule is replaced with the edited rule. It is possible that the previous rule is stored into the ROM so that the rule can be restored. With another type tone generator having a function of simultaneous generation of a plurality of tone colors, rules and membership functions can be assigned to each tone color, and some rules can be shared in some tone colors.

It is also possible that the input data used in the fuzzy inference is output data of a joy-stick or operation data of a pitch-vending wheel or the like. In the present example, the fuzzy inference is performed in real time during playing. In place of the real time process, it is possible that all of the fuzzy inference are performed in idle time, and the result is stored in a memory, then the stored data is read during the actual playing time.

What is claimed is:

1. An electronic musical instrument having a fuzzy inference function comprising:
   - playing data input means for inputting playing data;
   - rule storage means for storing a plurality of fuzzy inference rules;
   - rule selection means for selecting rules to be activated from among the plurality of fuzzy inference rules while the electronic musical instrument is being played; and
   - fuzzy inference means for fuzzy-inferring musical tone control parameters based on the playing data inputted from the playing data input means using the selected rules, wherein each of the plurality of fuzzy rules designates a relation between the inputted playing data and the musical tone control parameters.

2. An electronic musical instrument having a fuzzy inference function according to claim 1, said musical tone control parameters include a control amount of amplitude fluctuation, a control amount of pitch fluctuation and a control amount of noise.

3. An electronic musical instrument having a fuzzy inference function according to claim 1, wherein additional fuzzy rules and one or more membership functions used for implementing the fuzzy rules can be inputted and edited while the musical instrument is being played.

4. An electronic musical instrument having a fuzzy inference function according to claim 1, said fuzzy inference means comprising a plurality of registers for storing input data, a plurality of rule arithmetic circuits including membership functions, each of which performs an operation in a fuzzy condition part according to the input data, gate means for gating the rule arithmetic circuits to be used, maximum calculating means for performing maximum calculating based on output data from the gated rule arithmetic circuits, and center-of-gravity calculating means for performing center-of-gravity calculation based on output data from the maximum calculating means.

5. An electronic musical instrument having a fuzzy inference function comprising:
   - playing data input means for inputting playing data;
   - fuzzy rule input means for inputting a fuzzy rule to be used for the fuzzy inference function; and
   - fuzzy inference means for fuzzy-inferring successive parameters for musical tone controlling in real time according to the inputted fuzzy rule.

6. An electronic musical instrument having a fuzzy inference function according to claim 5, further comprising musical tone signal generation means for generating a musical tone signal based on said parameters.

7. The electronic musical instrument of claim 5 wherein the playing data is fetched for every specified period after tone generation and wherein the fuzzy inference means infers the musical tone parameters based on the fetched playing data.

8. The electronic musical instrument of claim 7 further comprising a musical tone generating means for generating a musical tone based on the musical tone parameters.

9. The electronic musical instrument of claim 7 wherein the playing data includes after-touch data.

10. An electronic musical instrument having a fuzzy inference function comprising:
   - playing data generation means for generating playing data including pitch data, touch data, and start timing data of a musical tone to be generated;
   - fuzzy interference means for performing fuzzy inference based on said pitch data and said touch data;
   - parameter generating means for generating musical tone parameters in accordance with said fuzzy inference;
   - control means for controlling transfer of said musical tone parameters and for generating note on data in response to said start timing data; and
   - musical tone signal generation means for generating a musical tone based on said musical tone parameters and in response to said note on data.

11. The electronic musical instrument of claim 10 wherein said musical tone parameters generated by said parameter generating means are changed with time, and wherein said playing data includes continuous playing data.

12. The electronic musical instrument of claim 10 wherein said fuzzy inference means performs said fuzzy inference independent of said note on data.

* * * * *

UNITED STATES PATENT AND TRADEMARK OFFICE

CERTIFICATE OF CORRECTION

PATENT NO. : 5,274,191

DATED : December 28, 1993

INVENTOR(S) : Satoshi Usa

It is certified that error appears in the above-indentified patent and that said Letters Patent is hereby corrected as shown below:

On drawing sheet
Figure 7 should be deleted to be replaced with Figure 7 as shown on the attached sheet.

Signed and Sealed this

Eighteenth Day of October, 1994

*Attest:*

Bruce Lehman

BRUCE LEHMAN

*Attesting Officer*

*Commissioner of Patents and Trademarks*

| (INPUT FUZZY OPERATION) | | (WRITING REGISTER OF FUZZY OPERATOR) | | (FUNCTION USED FOR MIN. CALCULATION) | (RULE) |
|---|---|---|---|---|---|
| MN1(VEL) | → | R1 | · · · | F1N | NOISE AMOUNT CONTROL BY VELOCITY |
| MN2(VEL) | → | R2 | · · · | F2N | |
| MN3(KCD) | → | R3 | · · · | F3N | KEY SCALING BY NOISE AMOUNT |
| MN4(KCD) | → | R4 | · · · | F4N | |
| MN5(AFT) | → | R5 | · · · | F5N | NOISE AMOUNT AND STABILIZATION CONTROL BY AFTER TOUCH |
| MN6(AFT) | → | R6 | · · · | F6N | |
| MN7(VEL) | → | R7 | · · · | F7N | NOISE STABILIZATION CONTROL BY VELOCITY |
| MN8(VEL) | → | R8 | · · · | F8N | |
| MN9(KCD) | → | R9 | · · · | F9N | KEY SCALING BY NOISE STABILIZATION |
| MN10(KCD) | → | R10 | · · · | F10N | |
| MN11(VEL) | → | R11 | · · · | F11N | NOISE SMALL DEGREE AND NOISE STABILIZATION FOR SLUR PERIOD |

FIG. 7